US007100672B2

(12) United States Patent
Park

(10) Patent No.: US 7,100,672 B2
(45) Date of Patent: Sep. 5, 2006

(54) DEVICE FOR COOLING DIE CASTING METALLIC PATTERN

(75) Inventor: Jung Chul Park, Suwon (KR)

(73) Assignee: Kia Motors Corporation, Seoul (KR)

( * ) Notice: Subject to any disclaimer, the term of this patent is extended or adjusted under 35 U.S.C. 154(b) by 0 days.

(21) Appl. No.: 10/983,224

(22) Filed: Nov. 4, 2004

(65) Prior Publication Data

US 2005/0092457 A1 May 5, 2005

(30) Foreign Application Priority Data

Nov. 4, 2003 (KR) ..... 10-2003-0077692

(51) Int. Cl.
*B22D 27/04* (2006.01)

(52) U.S. Cl. ..... 164/312; 164/348

(58) Field of Classification Search ..... 164/312, 164/348, 128

See application file for complete search history.

(56) References Cited

U.S. PATENT DOCUMENTS

| | | | | |
|---|---|---|---|---|
| 3,583,467 | A * | 6/1971 | Bennett et al. | 164/458 |
| 4,493,362 | A * | 1/1985 | Moore et al. | 164/457 |
| 4,616,690 | A * | 10/1986 | Demange et al. | 164/128 |
| 4,798,237 | A * | 1/1989 | Nakano | 164/255 |
| 4,976,305 | A * | 12/1990 | Tanaka et al. | 164/458 |
| 5,647,426 | A * | 7/1997 | Prieto et al. | 164/348 |
| 5,772,933 | A * | 6/1998 | Kotzab | 264/40.6 |

* cited by examiner

*Primary Examiner*—Len Tran
(74) *Attorney, Agent, or Firm*—Morgan Lewis & Bockius LLP

(57) ABSTRACT

While a die cast product is produced by a die casting method, an overheated portion of a low pressure die casting metallic pattern is effectively cooled by circulating a cool air and/or a coolant. Therefore, a solidification period of a molten metal in a cavity is minimized, and a quality of products and a durability of the metallic pattern are improved.

4 Claims, 2 Drawing Sheets

DEVICE FOR COOLING DIE CASTING METALLIC PATTERN

CROSS-REFERENCE TO RELATED APPLICATIONS

This application claims priority of Korean Application No. 10-2003-0077692, filed Nov. 4, 2003, the disclosure of which is incorporated herein by reference.

FIELD OF THE INVENTION

Generally, the present invention relates to a device for cooling a die casting metallic pattern. More particularly, the present invention relates to a device for cooling a low pressure die casting metallic pattern that cools an overheated portion by utilizing cool air and coolant.

BACKGROUND OF THE INVENTION

Die casting is a precision casting method that produces castings of the same size with a metallic pattern by injecting molten metals into a metallic pattern that is precisely fashioned corresponding to a die casting model. The die cast product size can be very precise. One advantage of die casting is that trimming is not typically required, and mechanical quality is very good. In addition, a characteristic of the method is that mass production is possible.

A metal such as zinc, aluminum, tin, copper, and their alloys may be used in die casting. A die casting apparatus cools and solidifies the molten metal for making the products after injecting the molten metal in the metallic pattern by utilizing air pressure, water pressure, or oil pressure.

An exemplary metallic pattern used in die casting is a metallic mold as shown, for example, in FIG. 2. Such a metallic pattern may include an upper mold 101, a side mold 103, and a lower mold 105. A product cavity 107 is formed by coupling of the molds 101, 102, and 103. A plug 109 is mounted in the upper mold 101 such that it is disposed in the cavity 107. In addition, an orifice 111 connected with a holding furnace (not shown) of the casting apparatus is mounted in the lower mold 105. Therefore, a molten metal is injected into the cavity 107 through the orifice 111.

When the molten metal is injected into the cavity of the metallic pattern, the molten metal is cooled and solidifies naturally to form a cast product. However, the solidification period of the molten metal can be excessive. In addition, the temperature difference between the upper mold and the lower mold is usually more than 50 degrees centigrade. Because of the large temperature difference, the cooling speed of the molten metal may differ within the mold. The difference in the cooling speed can deteriorate the quality and durability of the product because of an overheated metallic pattern.

The information disclosed in this Background of the Invention section is only for enhancement of understanding of the background of the invention and should not be taken as an acknowledgement or any form of suggestion that this information forms the prior art that is already known in this country to a person of ordinary skill in the art.

SUMMARY OF THE INVENTION

Embodiments of the present invention provide a device for cooling a super-heated portion using cool air and coolant passages in a low pressure die casting metallic pattern.

An exemplary device for cooling a die casting metallic pattern according to an embodiment of the present invention includes the die casting metallic pattern including a cavity formed by coupling an upper mold, a side mold, and a lower mold. The upper mold may include a plug disposed in the cavity. Cool air passages are mounted in the upper mold and the side mold respectively for passing the cool air.

In a further embodiment, a coolant passage is mounted in the lower mold for passing the coolant, and a central hollow portion is mounted in the plug for opening its upper portion. An external air pump is connected to a first cool air pipe and a second cool air pipe. The first cool air pipe and second cool air pipe are connected to the cool air passage mounted in the upper mold and the side mold. An external coolant pump is connected to a coolant pipe, which is connected to a coolant passage mounted in the lower mold. The coolant is supplied to the coolant passage through the coolant pipe. A front end of a pipe branched out of the second cool air pipe is mounted in the central hollow portion of the plug.

A first temperature detecting sensor, a second temperature detecting sensor, and a third temperature detecting sensor are respectively mounted in the upper mold, the side mold, and the lower mold for detecting temperature of the upper mold, the side mold, and the lower mold and outputting the temperature to a controller. Preferably, a first shut-off valve, a second shut-off valve, and a third shut-off valve are mounted in one end of the first cool air pipe, the second cool air pipe, and the coolant pipe respectively. The first, second, and third shut-off valves shut-off and open the cool air and coolant pipe by a signal of the controller. Preferably, the coolant is a liquid coolant.

In a further embodiment, the device for cooling a die casting metallic pattern includes at least one area of high temperature and at least one area of lower temperature. Preferably, the device includes a first coolant passage communicating with the higher temperature area. A second coolant passage communicates with the lower temperature area. Temperature sensors are located in the higher and lower temperature areas.

The device also may include a first coolant pump for supplying the first coolant passage and a second coolant pump for supplying the second coolant passage. A controller receives signals from the temperature sensors indicative of the temperature sensed in the higher and lower temperature areas, and controls operation of the pumps based on the signals to deliver coolant to the higher and lower temperature areas so as to at least approximately maintain a common temperature in those areas.

In a preferred alternative embodiment, the first coolant may be a liquid coolant and the first coolant pump is a liquid coolant pump. The second coolant may be a gas, and the second coolant pump at least one gas pump. The first coolant preferably has a higher heat capacity than the second coolant.

In a further embodiment, the second coolant is air.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

An embodiment of a present invention will hereinafter be described in detail with reference to the accompanying drawings.

Figure 1:
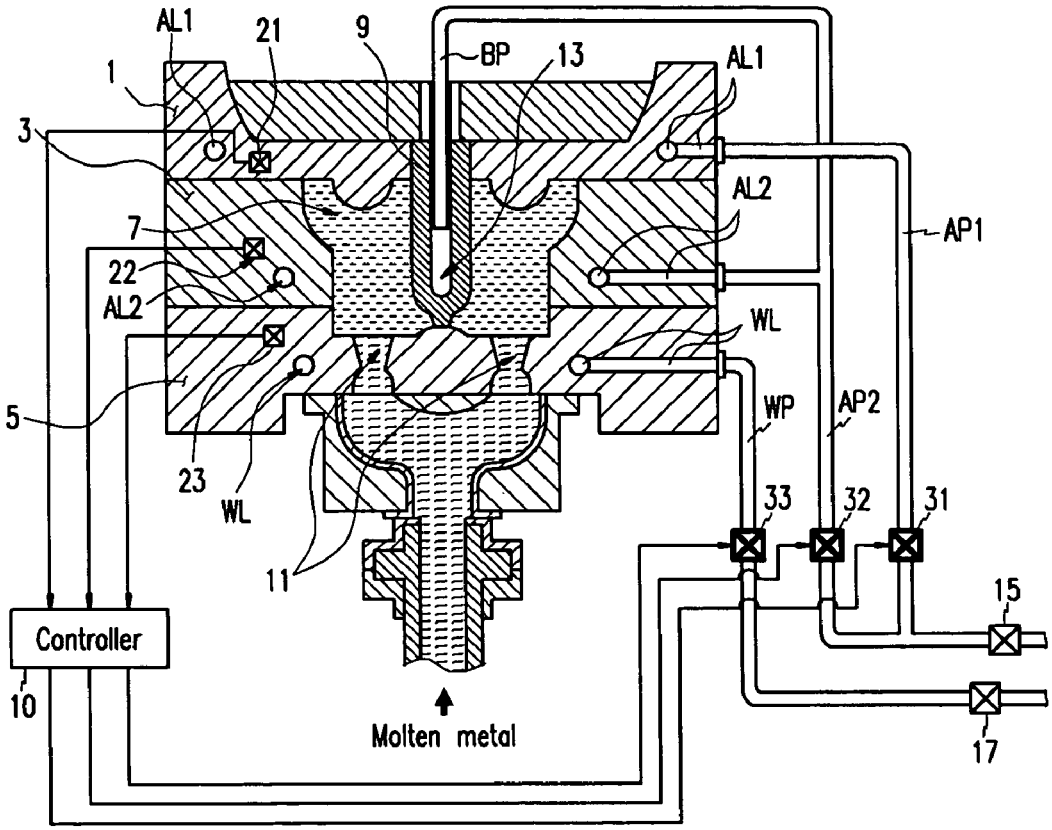
FIG. 1 is a schematic view of a device for cooling a die casting metallic pattern according to an embodiment of the present invention.
Figure 2:
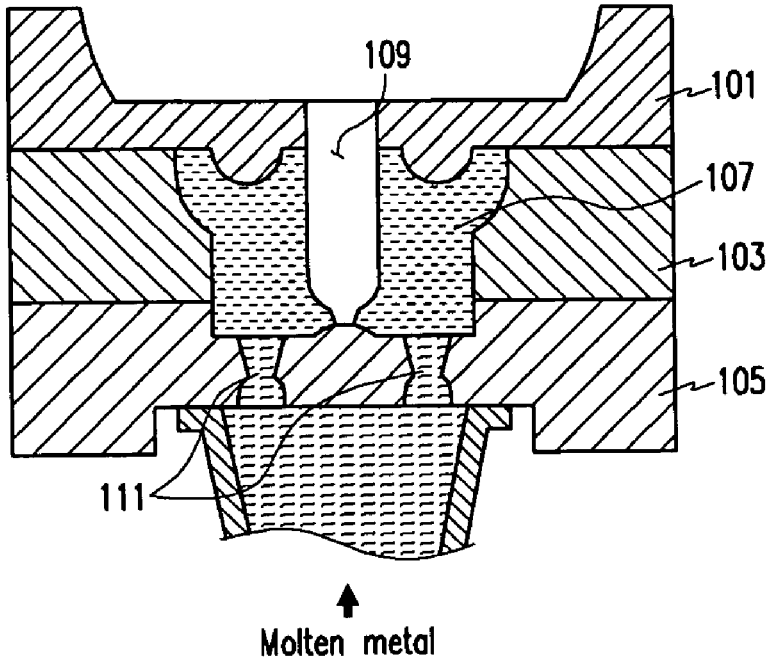
FIG. 2 is a sectional view of the die casting metallic pattern according to the prior art.

As shown in FIG. 1, a die casting metallic pattern that is applied with a device according to an embodiment of the present invention includes an upper mold 1, a side mold 3, and a lower mold 5. A cavity 7 is formed in the molds, and the upper mold 1 includes a plug 9 disposed into the cavity 7. In addition, an orifice 11 connected with a holding furnace (not shown) of the casting apparatus is formed in the lower mold 5. Therefore, a molten metal is directly injected to the cavity 7 through the orifice 11.

According to an embodiment of the present invention, the scheme of the device for cooling a die casting metallic pattern will be hereinafter described.

A first cool air passage AL1 and a second cool air passage AL2 are mounted in the upper mold 1 and the side mold 3 respectively for circulating cool air. A coolant passage WL is formed in the lower mold 5 for passing coolant. In addition, a central hollow portion 13 is formed in the plug 9 such that an upper portion of the plug 9 is open.

An air pump 15 may be exteriorly connected to a first cool air pipe AP1 and a second cool air pipe AP2. The first air pipe AP1 and the second air pipe AP2 are respectively connected to the first cool air passage AL1 and the second air passage AL2 formed in the upper mold 1 and the side mold 3. The cool air is respectively supplied to the first air passage AL1 and the second air passage AL2 through the first air pipe AP1 and the second air pipe AP2.

A coolant pump 17 may be exteriorly connected to a coolant pipe WP. The coolant pipe WP is connected to the coolant passage WL formed in the lower mold 5. The coolant is supplied to the coolant passage WL through the coolant pipe WP.

A front end of a branch pipe BP branches out of the second cool air pipe AP2, and the front end is connected in the central hollow portion 13 of the plug 9. The cool air is supplied to the central hollow portion 13 through the branch pipe BP.

First, second, and third temperature sensors 21, 22, and 23 are respectively mounted in the upper mold 1, the side mold 3, and the lower mold 5 for detecting temperatures thereof, and outputting the temperatures to a controller 10. First, second, and third shut-off valves 31, 32, and 33 are respectively mounted in the first cool air pipe AP1, second cool air pipe AP2, and the coolant pipe WP. The first, second, and third shut-off valves 31, 32, and 33 selectively shut off and open the pipes AP1, AP2, and WP by a signal of the controller 10. The first, second and third shut-off valves 31, 32, and 33 can be formed as solenoid valves that are controlled on and off by the signal of the controller 10. Controller 10 may comprise a processor and associated hardware and software as may be selected and programmed by a person of ordinary skill in the art based on the teachings herein.

In case that temperature detected by the first, the second, and/or the third temperature sensors 21, 22, and 23 is greater than a predetermined temperature, the controller 10 turns on a corresponding one of the first, the second, and the third shut-off valves 31, 32, and 33, such that a corresponding one of the pipes AP1, AP2, and WP becomes open. Therefore, according to an embodiment of a device for cooling a die casting metallic pattern, cool air and coolant can be continuously supplied to the first and second air pipes AP1 and AP2 and the coolant pipe WP by the air pump 15 and the coolant pump 17.

Hereinafter, operation of a die casting apparatus applied with such a device for cooling a die casting metallic pattern is described with respect to an exemplary embodiment.

Firstly, molten metal is supplied to the cavity 7 through orifice 11 of the lower mold 5.

When the molten metal fills in cavity 7, heat of the molten metal is conducted to the upper mold 1, side mold 3, and lower mold 5. Accordingly, the first, second, and third temperature sensors 21, 22, and 23 detect the temperature of the upper mold 1, side mold 3, and lower mold 5 and output the temperatures to a controller 10.

If any of the locations detected by the first, second, and third temperature sensors 21, 22, and 23 are at a temperature greater than a predetermined temperature, the controller turns on a corresponding one of the first, the second, and the third shut-off valves 31, 32, and 33 such that a corresponding one of the first cool air pipe AP1, the second cool air pipe AP2, and the coolant pipe WP is opened. When the first or second air pipe AP1 or AP2 is opened, cool air may be supplied from the air pump 15 to the first or second cool air passages AL1 or AL2 formed in the upper mold 1 or side mold 3.

In addition, when the coolant pipe WP is opened, coolant may be supplied from the coolant pump 17 to the coolant passage WL formed in the lower mold 5.

Therefore, each of the molds 1, 3, and 5 is cooled by cool air or coolant so they can be maintained below the predetermined temperature. Durability of the metallic pattern is therefore enhanced since a solidification period of the molten metal is shortened and overheating of the molds is prevented.

In addition, whereas the upper mold 1 and side mold 3 are cooled by the cool air, the lower mold 5 is cooled by the coolant that preferably has a higher cooling efficiency. Therefore, the temperature of the lower mold 5, which was typically higher than that of the upper mold 1 by more than 50° in the prior art, is lowered to same or close to the same as that of the upper mold 1. So, a torsion that may be caused by a difference of the temperature is prevented.

As described above, embodiments of the present invention provide for an overheated portion in a low pressure metallic pattern to be cooled by cool air and a coolant. Therefore, among other advantages, the solidification period for the molten metal in the cavity is minimized and the production period is shortened. In addition, because the difference in cooling speed caused by a temperature difference between upper and lower molds is minimized, a quality of the cast product is improved. Furthermore, because an overheating of the metallic pattern is prevented, durability of the metallic pattern is also enhanced.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A device for cooling a die casting metallic pattern having a cavity formed by coupling of upper, side, and lower molds, and a plug mounted to the upper mold and disposed toward the cavity, the device comprising:

cool air passages formed in the upper mold and the side mold for circulating cool air;

a coolant passage formed in the lower mold for circulating a coolant;

a central hollow portion formed in the plug such that an upper portion of the plug becomes open;

an air pump externally connected to the cool air passages formed in the upper and the side molds through first and second cool air pipes;

a coolant pump externally connected to the coolant passage formed in the lower mold through the coolant pipe;

a branch pipe branched out of the second cool air pipe and connected to the central hollow portion;

first, second, and third temperature sensors respectively mounted in the upper, side, and lower molds for detecting temperatures thereof and for outputting the temperatures to a controller; and first, second, and third shut-off valves respectively mounted in the first cool air pipe, second cool air pipe, and the coolant pipe for selectively shutting and opening the first and second cool air pipes and the coolant pipe under the control of the controller.

2. The device of claim 1, wherein the first, second, and third shut-off valves are solenoid valves.

3. The device of claim 1, wherein, in the case that any of the temperatures detected from the first, second, and third temperature sensors is greater than a predetermined temperature, the controller turns on a corresponding one of the first, the second, and the third shut-off valves.

4. The device of claim 1, wherein the coolant is a liquid coolant.

* * * * *